United States Patent [19]

Kasuda

[11] Patent Number: 4,790,253

[45] Date of Patent: Dec. 13, 1988

[54] NEEDLE DRIVING APPARATUS FOR SEWING MACHINE

[75] Inventor: Takashi Kasuda, Osaka, Japan

[73] Assignee: Pegasus Sewing Machine Mfg. Co., Ltd., Osaka, Japan

[21] Appl. No.: 149,711

[22] Filed: Jan. 29, 1988

[30] Foreign Application Priority Data

Jan. 31, 1987 [JP] Japan ..... 62-13582[U]

[51] Int. Cl.[4] ..... D05B 55/14

[52] U.S. Cl. ..... 112/221

[58] Field of Search ..... 112/221, 220, 270; 74/104, 103

[56] References Cited

U.S. PATENT DOCUMENTS

| | | | |
|---|---|---|---|
| 2,799,236 | 5/1955 | Marforio et al. . | |
| 3,688,711 | 5/1970 | Szostak et al. . | |
| 3,745,951 | 7/1973 | Marforio | 112/221 |
| 4,079,685 | 6/1977 | Klundt . | |
| 4,259,916 | 4/1981 | Marchesi | 112/221 |

FOREIGN PATENT DOCUMENTS

| | | | |
|---|---|---|---|
| 2757667 | 6/1979 | Fed. Rep. of Germany | 112/221 |
| 59-21742 | 6/1984 | Japan . | |
| 22596 | 6/1986 | Japan | 112/221 |

*Primary Examiner*—H. Hampton Hunter

*Attorney, Agent, or Firm*—Flynn, Thiel, Boutell & Tanis

[57] ABSTRACT

A needle driving apparatus for a sewing machine for allowing oscillatory movement of a needle bar through the motion of a lever which oscillates up and down interlocking with a main shaft, wherein a rectangular slider is rotatably supported by a fork provided on the end of the oscillating lever. On the upper end of the needle bar is fixed a guide member having a guide groove which is orthogonal with the needle bar and slidably fitted to the fork of the oscillating lever, and the rectangular slider is fitted in the guide groove of the guide member.

5 Claims, 3 Drawing Sheets

NEEDLE DRIVING APPARATUS FOR SEWING MACHINE

BACKGROUND OF THE INVENTION

This invention relates to a needle driving apparatus for a sewing machine, particularly to a needle driving apparatus for a sewing machine wherein a needle bar is allowed to move up and down through the oscillatory motion of an oscillating lever interlocking with a main shaft.

In such type of needle driving apparatus, while the oscillating lever performs an arcuate movement, the needle bar performs a linear movement. Accordingly, an element is required at the junction of said lever and needle bar for compensating the difference in their movements. Most of this type of prior art needle driving apparatus employ a slider element as an element for compensating said difference. However, the slider element induces greater inertia .force because of its relatively great mass, consequently, to bring about unfavorable influence upon the stitches to be formed. Also, since the slider element is provided on the side of the needle bar and the line of action of the force to be acted by the oscillating lever onto the needle bar is somewhat apart from the axis of the needle bar, a component of force is generated in the direction to increase the frictional resistance between said needle bar and a bearing which slidably supports the needle bar, in addition to the force to drive the needle bar to move along the axial direction thereof. As a result, the frictional resistance between the needle bar and the bearing will be increased, and thus these members will be worn very soon disadvantageously.

There has been proposed an apparatus wherein the oscillating lever and the needle bar are connected by means of a link as disclosed in U.S. Pat. No. 4,079,685. In this apparatus, when the oscillating lever oscillates, the link slants to right or left while allowing the needle bar to be moved up and down. However, with the change in the direction that the link slants, the line of action of the force to be acted upon the needle bar changes, thereby the needle bar is susceptible to wobbling. In order to make the vertical movement of the needle bar stable, the bearing for supporting the needle bar should be elongated; whereas if the bearing is elongated, the needle bar will naturally be longer. Moreover, in this apparatus a space for the link is required above the needle bar, and as a result a larger space is necessary for disposing the needle driving apparatus.

The object of this invention is to provide a needle driving apparatus for a sewing machine which has overcome the problems mentioned above.

SUMMARY OF THE INVENTION

According to this invention, there is provided a needle driving apparatus for a sewing machine comprising an oscillating lever which oscillates up and down interlocking with a main shaft; a needle bar supported in a frame of the sewing machine such that it can move vertically; a guide member to be disposed on the upper end of the needle bar and provided with a linear guide groove which is orthogonal with the needle bar; and a slider to be rotatably supported horizontally between the arms of a fork extending forwardly from the end of said oscillating lever and slidably fitted to the guide groove of said guide member.

According to this invention, the mass of the slider can be made minimal to reduce the influence which may otherwise be caused by inertia force, since it may have a simple structure such that it can slide along the guide member; the piercing force of a needle to penetrate through the cloth under sewing will be greater, since the line of action of the force to be acted upon the needle bar through the contact surfaces of the slider and the guide member can be aligned or substantially be aligned with the axis of the needle bar; and also the frictional resistance between the needle bar and the bearing will be reduced, since the component of force in the direction to increase the frictional resistance between the needle bar and the bearing for supporting the needle bar may not be generated or is substantially absent, to reduce wear of these members.

The guide member according to this invention includes one wherein the guide groove has a form of slot. However, in a preferred embodiment, one having a U-shape is employed which is slidably fitted to the fork of the oscillating lever. The reason is because the assembling of these members will be easier by allowing the guide groove to have a U-shape. Further, while some countermeasures should be taken for preventing rotation of the needle bar, the possible rotation of the guide member can be regulated by slidably fitting the guide member to the fork, whereby the structure can be simplified by use of the guide member and the fork, without any additional means for preventing the rotation of the needle bar. Therefore, this invention is characterized in that the guide member has a U-shape, and that said guide member is slidably fitted to the fork of the oscillating lever.

As the slider in the preferred embodiment, a rectangular pin formed of flat upper and lower surfaces which are parallel to each other is used, which rectangular slider is rotatably supported by the fork of the oscillating lever through pinions protruding from both ends of the slider.

Also, in the preferred embodiment of this invention, the oscillating lever, guide member, etc. in the needle driving apparatus are disposed within the frame of the sewing machine of a closed structure. In a high-speed industrial sewing machine, while the needle driving apparatus oblige to be lubricated, potential problems that the lubricating oil is scattered with the oscillatory movement of the needle bar to stain the cloth under sewing or soil the operator can be solved by closing the lubricating oil feeding section. Accordingly, this invention is further characterized in that the needle driving apparatus is disposed within the frame of a sewing machine of a closed structure.

DESCRIPTION OF THE PREFERRED EMBODIMENT

Figure 1:
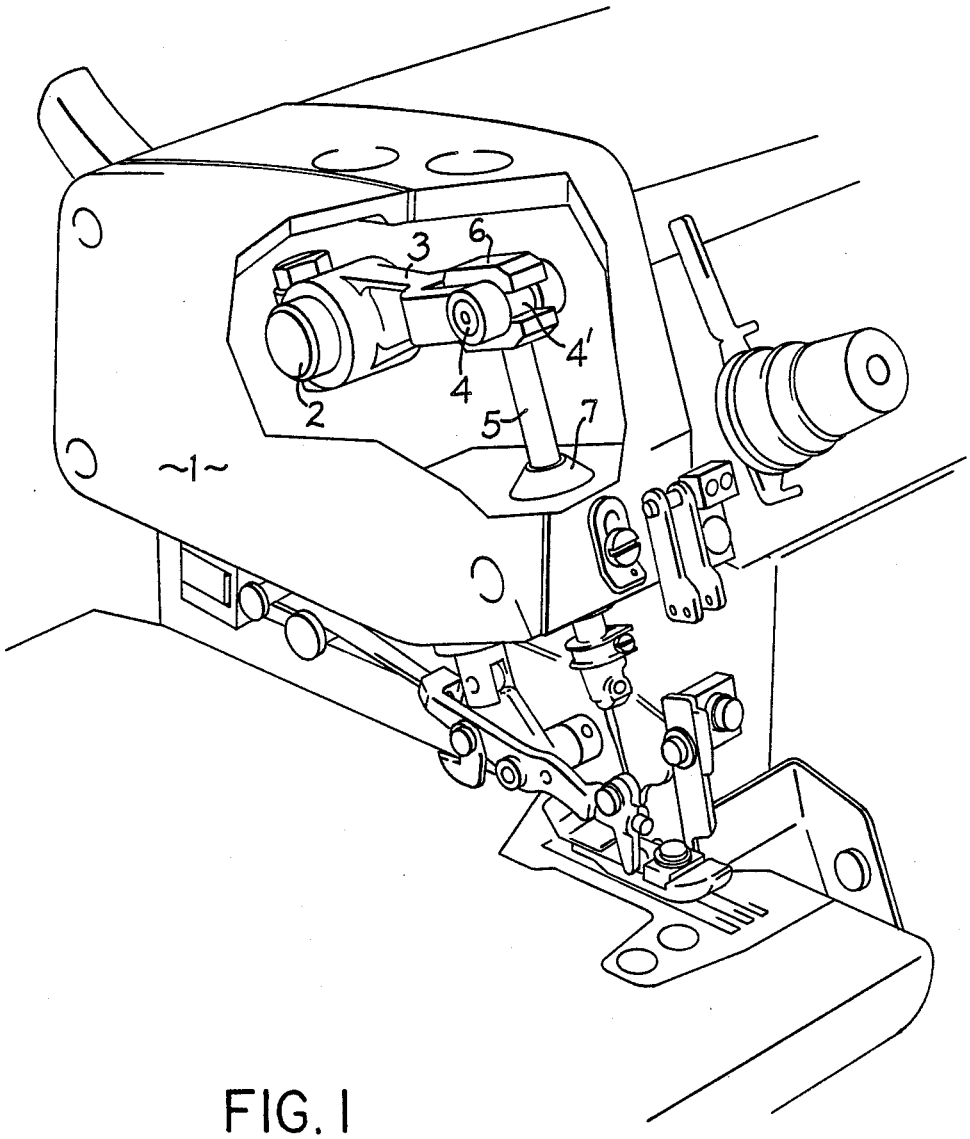
FIG. 1 shows a partially cutaway perspective view of the major section of an overedging sewing machine provided with the needle driving apparatus according to this invention.
Figure 2:
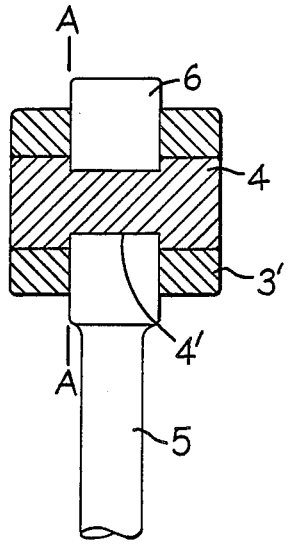
FIG. 2 shows a cross-sectional view of the end portion of the forked lever of the needle driving apparatus shown in FIG. 1.

FIG. 1 shows an embodiment in which the needle driving apparatus according to this invention is provided in an overedging sewing machine. In this embodiment, an oscillating lever 3 fixed onto the end portion of an oscillating shaft 2, which oscillates interlocking with the main shaft, is provided within the head 1 to protrude thereinto; and a slider 4 is rotatably supported horizontally by a fork 3' formed on the free end of said lever 3, said slider 4 being cutaway at the top and bottom portions to form flat surfaces which are parallel to each other, such that the portion of the slider supported between the arms of said fork may be formed into a rectangular portion 4'. Also, protruding into the head 1 is a needle bar 5 supported at the middle portion through a bearing 7 fixed to the frame such that the needle bar 5 may be moved up and down. On the upper end of the needle bar 5, a U-shaped guide member 6 having a linear guide groove 8 orthogonal with the needle bar 5 is formed, which member is slidably fitted to the fork 3' to regulate the rotation of the guide member 6, namely to prevent the rotation of the needle bar 5. Also, the rectangular portion 4' of the slider 4 is slidably fitted to the guide groove 8 (see FIGS. 2 and 3).

Figure 4:
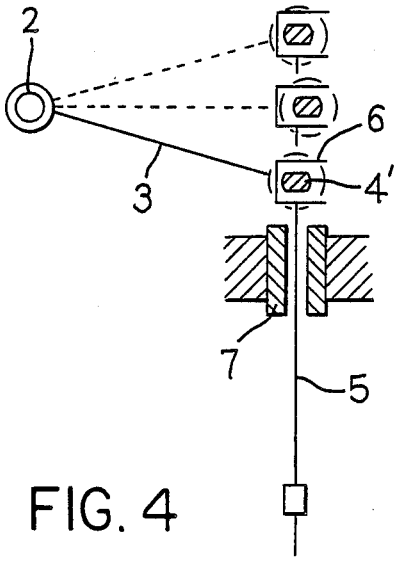
FIG. 4 illustrates the relationship between the slider and the guide member for guiding the needle bar which moves up and down through the oscillating motion of the forked lever.
Figure 3:
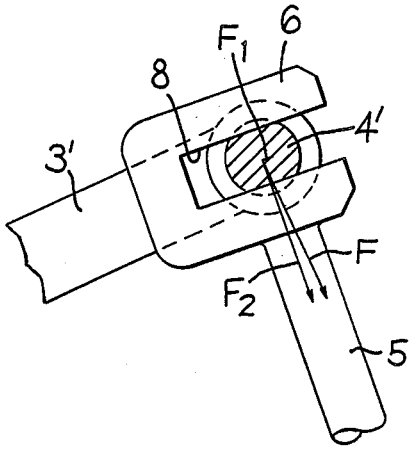
FIG. 3 shows a cross-sectional view of the portion shown in FIG. 2 taken along the line A—A.

The needle bar mechanism according to this embodiment has a constitution as has been described heretofore, wherein the rectangular portion 4' of the slider 4 pushes down or pulls up the needle bar 5 while sliding along the guide groove 8 of the guide member 6, with the oscillating motion of the oscillating lever 3, through the guide member 6 to allow ascending or descending of the needle bar (see FIG. 4). In such constitution, since the guide groove 8 is provided on the upper end of the needle bar as described above, and also said groove 8 is orthogonal with the needle bar 5, the direction of the component $F_1$, of the line of action to be acted by the slider 4 onto the guide member 6 which is orthogonal with the needle bar, is identical with the orientation of the guide groove 8 as shown in FIG. 3. Accordingly, $F_1$ does not act upon the needle bar. Namely, only the component $F_2$ in the axial direction of the needle bar acts upon the needle bar, whereby no wobbling is generated therefor. It should be noted that since the sliding of the rectangular portion 4' along the guide groove with the oscillating motion of the oscillating lever occurs substantially within the diameter of the needle bar 5 to right and left from the axis thereof, the component $F_2$ in the axial direction of the needle bar mentioned above will be or substantially be in alignment with the axis of the needle bar.

It is further understood by those skilled in the art that the foregoing description is preferred embodiments of the disclosed device and that various changes and modifications may be made in the invention without departing from the spirit and the scope thereof.

What is claimed is:

1. A needle driving apparatus for a sewing machine comprising an oscillating lever which oscillates up and down interlocking with a main shaft; a needle bar supported in a frame of the sewing machine such that it can move up and down; a guide member to be disposed on the upper end of the needle bar and provided with a linear guide groove which is orthogonal with the needle bar; and a slider to be rotatably supported horizontally between the arms of a fork extending forwardly from the free end of said oscillating lever and slidably fitted to the guide groove of said guide member.

2. The needle driving apparatus for a sewing machine according to claim 1, wherein the guide member has a U-shape.

3. The needle driving apparatus for a sewing machine according to claim 1, wherein the slider is formed to have flat upper and lower surfaces which are parallel to each other; said slider being fitted to the fork of the oscillating lever and rotatably supported by said fork by means of pinions protruding from the both ends of said slider.

4. The needle driving apparatus for a sewing machine according to claim 1, wherein the guide member is slidably fitted to the fork of the oscillating lever.

5. The needle bar driving apparatus for a sewing machine according to claim 1, wherein said needle driving apparatus is disposed in the frame of the sewing machine of a closed structure and the needle bar slidably supported by said frame to protrude therethrough downwardly.

* * * * *